US008237750B2

(12) United States Patent
Polak et al.

(10) Patent No.: US 8,237,750 B2
(45) Date of Patent: Aug. 7, 2012

(54) METHOD OF CORRECTING EMISSIVE DISPLAY BURN-IN

(75) Inventors: Robert D. Polak, Lindenhurst, IL (US); Andrew N. Cady, Chicago, IL (US); Tomohiro Ishikawa, Evanston, IL (US)

(73) Assignee: Motorola Mobility, Inc., Libertyville, IL (US)

( * ) Notice: Subject to any disclaimer, the term of this patent is extended or adjusted under 35 U.S.C. 154(b) by 949 days.

(21) Appl. No.: 12/257,072

(22) Filed: Oct. 23, 2008

(65) Prior Publication Data

US 2010/0103198 A1 Apr. 29, 2010

(51) Int. Cl.
*G09G 5/10* (2006.01)

(52) U.S. Cl. ..... 345/690; 345/693

(58) Field of Classification Search ..... 345/690–693; 438/14

See application file for complete search history.

(56) References Cited

U.S. PATENT DOCUMENTS

| | | | | |
|---|---|---|---|---|
| 6,473,065 | B1 | 10/2002 | Fan et al. | |
| 2002/0033783 | A1 | 3/2002 | Koyama | |
| 2003/0052904 | A1 * | 3/2003 | Gu | 345/691 |
| 2005/0017922 | A1 | 1/2005 | Devos et al. | |
| 2006/0007204 | A1 | 1/2006 | Reddy et al. | |
| 2006/0007248 | A1 | 1/2006 | Reddy et al. | |
| 2006/0007249 | A1 | 1/2006 | Reddy et al. | |
| 2006/0063281 | A1 | 3/2006 | Cok et al. | |
| 2007/0109284 | A1 | 5/2007 | Yamazaki et al. | |
| 2007/0229405 | A1 | 10/2007 | Moon et al. | |
| 2009/0109835 | A1 * | 4/2009 | Green | 370/210 |

FOREIGN PATENT DOCUMENTS

| | | |
|---|---|---|
| EP | 1376520 | 2/2004 |
| EP | 1653433 A2 | 5/2006 |
| JP | 2002-20745 | 7/2002 |
| JP | 2004-295644 A | 10/2004 |

OTHER PUBLICATIONS

Polak, B., Ishikawa, T., Cady, A., "Preventing Burn-In Appearance in Emissive Displays", Date: May 6, 2008, pp. (slides) 1-39; Motorola, Inc.

Supplementary European Search Report, European Patent Office, Munich, Mar. 23, 2012, all pages.

* cited by examiner

*Primary Examiner* — Kimnhung Nguyen

(57) ABSTRACT

A method and apparatus are provided for correcting burn-in in a flat screen display. The method includes the steps of determining a maximum cumulative luminance of each pixel (15) within the display (14) based upon a usage of the pixel, providing a modulation map (40) of the display (14) from the maximum cumulative luminance of each pixel (15) within the display (14), transforming the modulation map (40) based upon the maximum cumulative luminance of groups of adjacent pixels to provide a modulation index for each pixel location of the map (40), comparing the modulation indexes with a set of threshold values and adjusting a luminosity of associated pixels (15) of the display (40) when the modulation index exceeds the threshold.

12 Claims, 15 Drawing Sheets

BURN-IN PATTERN

METHOD OF CORRECTING EMISSIVE DISPLAY BURN-IN

FIELD OF THE INVENTION

The field of the invention relates to displays and more particularly to a method of correcting burn-in of emissive display devices.

BACKGROUND OF THE INVENTION

The use of emissive displays such as organic light emitting diodes (OLEDs) on portable telephones and data devices are well known. Such displays allow an operating system within the telephone or data device to display status of operation and data to a user.

In the case of incoming calls, the display may inform the user of the identity of a caller. In the case of outgoing calls, the display may provide the user with an entered telephone number in order to allow the user to correct mistakes.

In the case of a portable device, the display may show a battery monitor that indicates a battery charge status. As the battery reaches a critical level the battery monitor may flash to notify the user of the need to recharge or suspend use.

In the case of portable telephones or data devices, status indicators are typically displayed in a single, respective location on the display for the convenience of the user. For example, a battery status indicator may be displayed in an upper right corner. Alternatively, the status indicator "CALLING" may be displayed in a center as may the words "SHUTTING DOWN" to indicate deactivation of the cell phone.

In general, emissive displays can experience a burned-in brightness or luminance modulation extending across the display caused by showing the same image over prolonged periods of time. The lifetimes of phosphors creating the image are finite and the luminance will decrease with time. As a result, when a different image is shown over the burned-in image, there will be local variations in luminance.

The luminance of many emissive displays decreases the more they are used. As the burned-in modulation increases, the display can become difficult if not impossible to read. Because of the importance of emissive displays a need exists for methods of ameliorating the effects of burn-in.

SUMMARY

A method and apparatus are provided for correcting burn-in in a display such as an OLED display, a plasma display panel (PDP) or a cathode ray tube (CRT). The method includes the steps of determining a maximum cumulative luminance of each pixel within the display based upon a usage of the pixel, providing a modulation map of the display from the maximum cumulative luminance of each pixel within the display, transforming the modulation map based upon the maximum cumulative luminance of groups of adjacent pixels to provide a modulation index for each pixel location of the map, comparing the modulation indices with a set of threshold values and adjusting a luminosity of associated pixels of the display when the modulation index exceeds the threshold.

BRIEF DESCRIPTION OF THE DRAWINGS

FIG. 3 depicts the graph of FIG. 2 along with methods of avoiding visible burn-in;

FIGS. 15-19 show a progression of screens that may be used by a screen saver processor of FIG. 1 to avoid burn-in;

DETAILED DESCRIPTION OF AN ILLUSTRATED EMBODIMENT

Figure 1:
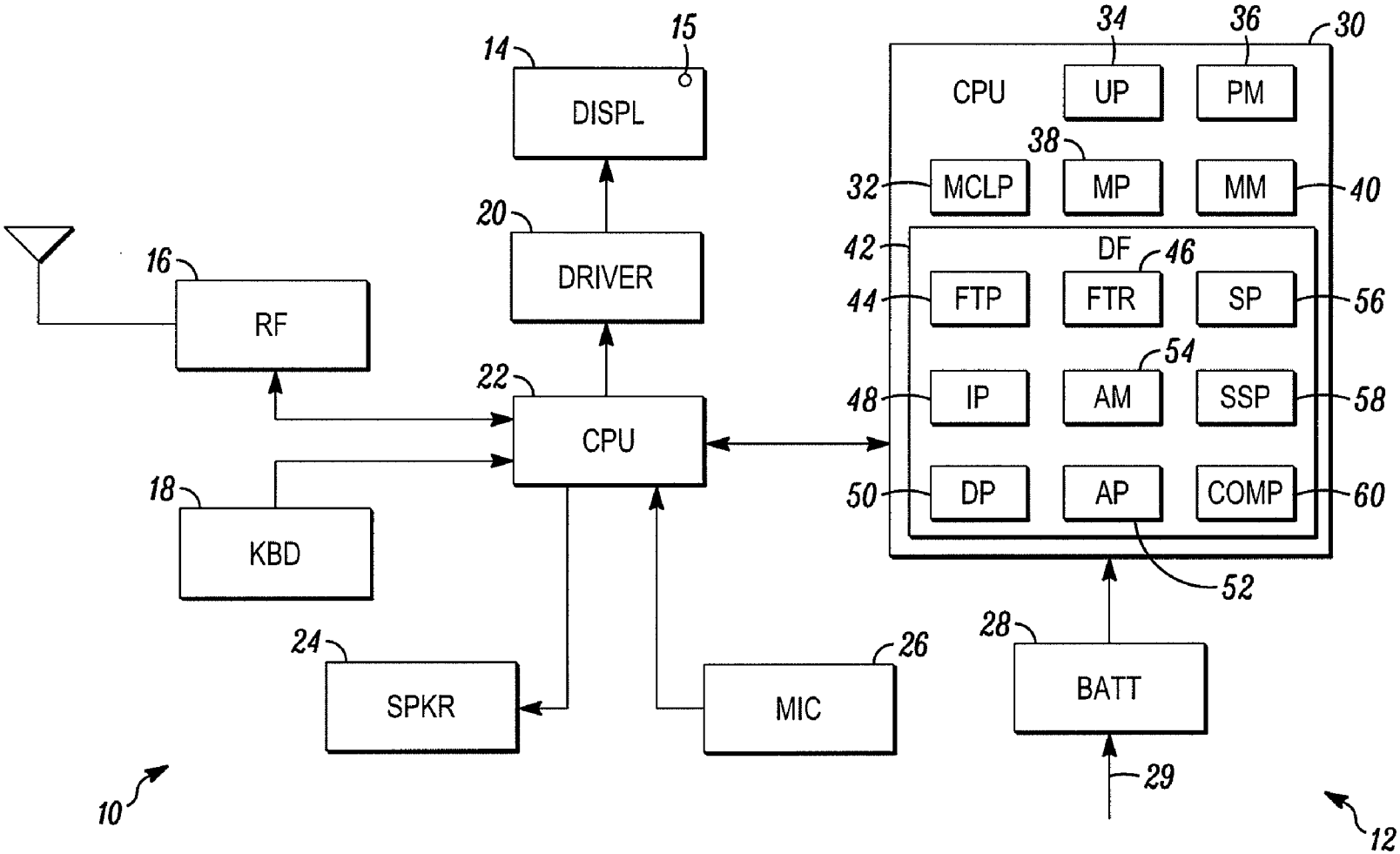
FIG. 1 is a block diagram of a system for correcting burn-in shown generally in accordance with an illustrated embodiment of the invention.

FIG. 1 shows a portable device (e.g., a cellphone, PDA, etc.) 10 shown generally in accordance with an illustrated embodiment of the invention. Included within the portable device 10 is an emissive display burn-in correction system 12.

In the case where the portable device 10 is a cellphone, then the portable device 10 may include a radio frequency transceiver 16 for transceiving information with a base station (not shown), a CPU 22 for processing the information and a speaker 24 and microphone 26 for exchanging voice information between a user and the base station.

The device 10 may also include an emissive display (e.g., OLED, etc.) 14, a driver 20 and a keyboard 18 that operates as a user interface. In this case, the keyboard 18 may be used by a user to enter dialed telephone numbers or to accept incoming calls. Entered numbers and status information may be displayed on the display 14. To display entered numbers and status information, the CPU 22 may activate the individual pixels 15 of the display 14 via operation of a driver 20.

The burn-in correction system 12 includes a central processing unit (CPU) 30 that monitors use of each pixel within the display 14 to detect burn-in. Use in this case can be determined by the ON time of each pixel or by a product of the time and current passing through each pixel. It can also be determined by measuring the current vs. voltage curve for each pixel. The ON time of each pixel 15 is accumulated within a respective pixel usage file within a pixel memory 36 of the CPU 30.

Figure 21:
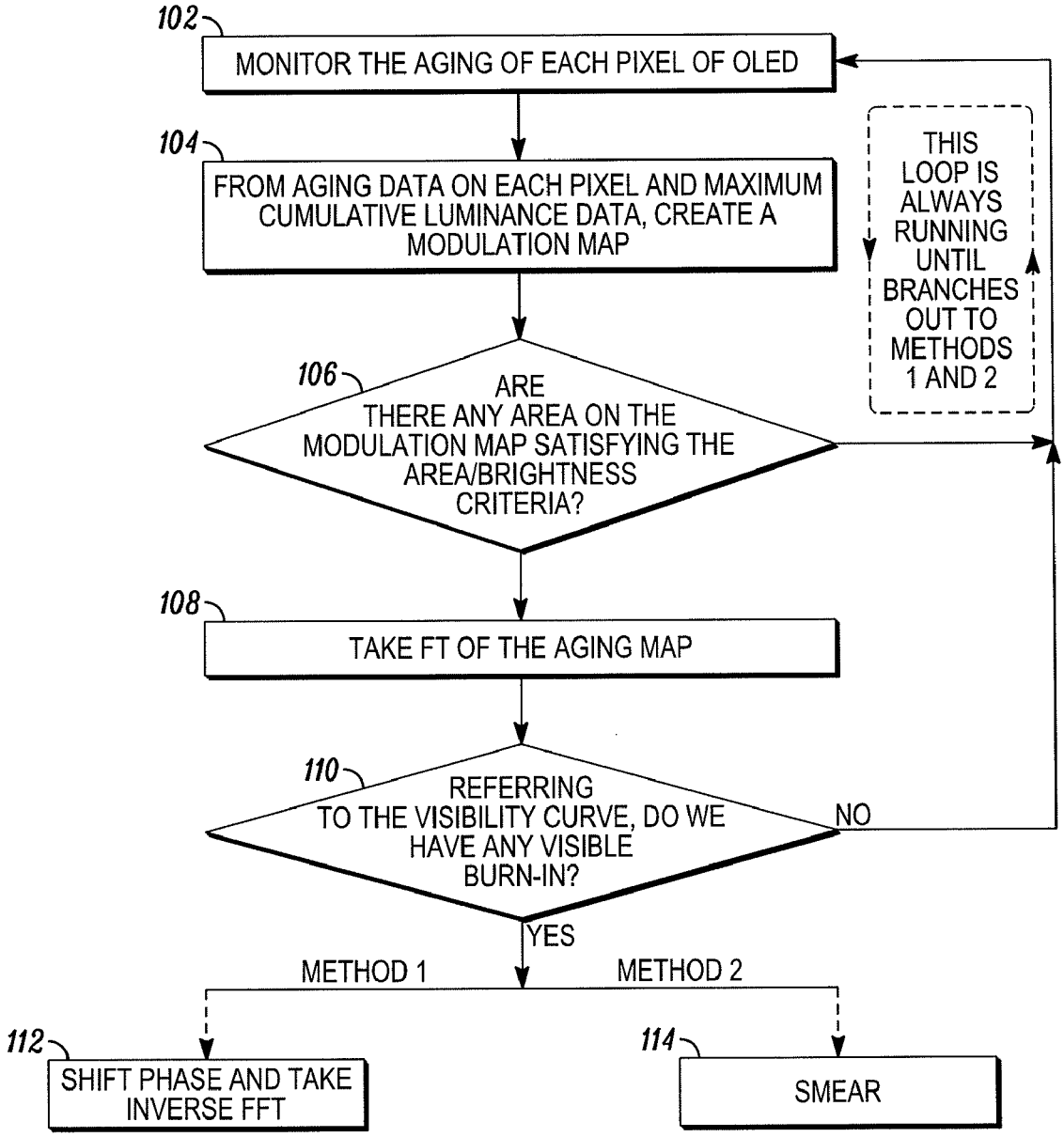
FIG. 21 depicts a method of correcting burn-in that may be used by the system of FIG. 1.

FIG. 21 depicts a set of process steps that may be followed by the CPU 30. Reference will be made to FIG. 21 as appropriate to an understanding of the invention.

As is known in the art, as pixels age (based upon the time of use or time and current), the optical output (i.e., luminance) of each pixel 15 decreases. As is also known, the decrease in luminance proceeds along a maximum cumulative luminance profile or graph 32 that is known in advance. As used herein, maximum cumulative luminance is the maximum illumination that can be produced by a pixel using a nominal input signal.

For example, when the display 14 is first manufactured, the output of each pixel may have a light output having a value of "a" lumens. After the pixel has been activated for some cumulative time period "b", the pixel may have a light output of only "c" lumens, where c is less than a. In this circumstance, the light output at time period b can be determined, in advance, by accessing the maximum cumulative luminance graph 32 using the time period b in an index for retrieving c.

In order to monitor usage 102 of each of the pixels 15, a usage processor 34 may periodically sample (e.g., every 100 ms) the state of the display 14 via a message sent to the display driver 20. The driver 20 in turn responds with an ON or OFF state of each of the pixels 15. Upon receiving the state of each pixel 15, the usage processor 34 may integrate the total ON time by incrementing the respective storage location for each ON pixel 15. Pixels that were not activated during the sample period are not incremented.

Similarly, the usage of pixel 15 may also be determined by determining an ON time and a current that is activating the pixel 15 during each sample period. In this case, the current may be used to scale an incremental value. The scaled incremental value may then be added to the respective memory locations of the pixels 15 within the memory 36.

Periodically, a modulation processor 38 may retrieve the usage value of each pixel 15 from the pixel usage memory 36 and, in turn, a maximum cumulative luminance value for the pixel 15 from the maximum cumulative luminance graph 32. As the maximum cumulative luminance value for each pixel 15 is retrieved, it may be saved 104 in a respective location within a modulation map 40.

Figure 20:
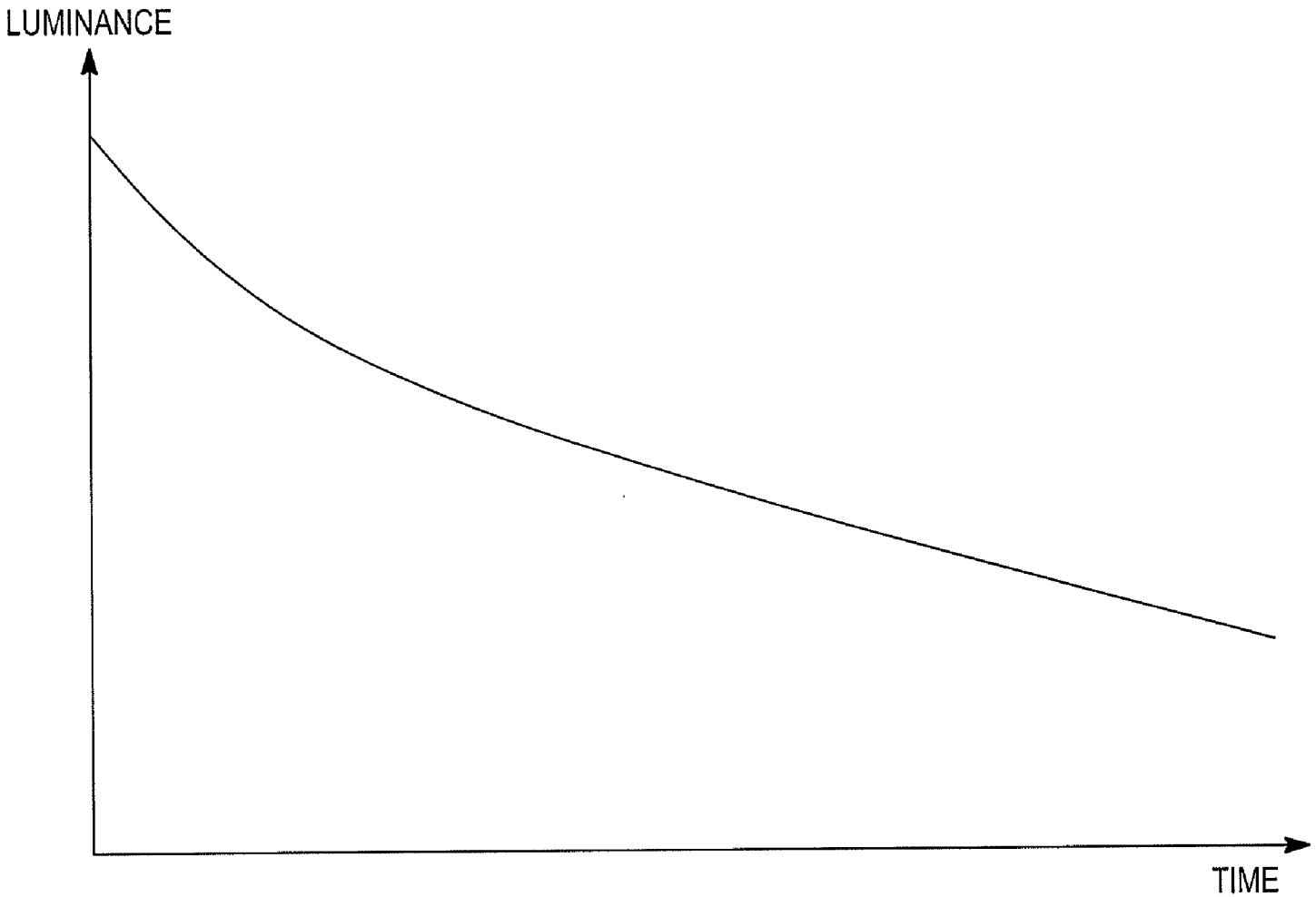
FIG. 20 shows a luminance versus time curve that may be used by the system of FIG. 1

From the above steps, a full characterization of the remaining brightness of each of the pixels 15 of the display 14 is determined. For example, FIG. 20 is a graph of luminance versus hours of ON-time for one type of pixel of a particular display. From FIG. 20, the luminance of a pixel may be retrieved for any usage value.

When a given percentage (e.g., xx %) are determined to suffer from burn-in (e.g., yy % decrease in brightness from an original brightness value) based upon a modulation index, then the display 14 has reached a brightness threshold. In evaluating whether the brightness threshold has been exceeded, the process includes determining whether there are any groups of pixels with less than the required brightness level exceeding a critical size. If not, then the system 12 goes back to monitoring pixels.

In general, four cases may be considered in determining whether the threshold has been exceeded. First, if a pixel group has a brightness modulation less than a certain brightness level then the group does not meet the criteria required for correction. Second, if a group has a brightness modulation greater than a certain brightness level, but the area is smaller than a critical size, then the group still does not meet the criteria required for correction. In a third situation, if a group has a brightness modulation greater than a certain brightness level and the area is greater than a critical size, then the group also does not meet the criteria required for correction. In the fourth situation, if a pixel group has a brightness modulation less than a certain brightness level and the area is greater than the critical size, then the pixel group should be corrected.

Alternatively, the modulation processor 38 may simply compare the original brightness value from the graph 32 and calculate how many pixels 15 are below the yy % threshold. The modulation processor 38 may then divide the number of pixels below the threshold by the total number of pixels in the display 14. If the quotient is below the threshold of xx %, then the system 12 corrects the burn-in profile to reduce the visibility of the burned-in pixels 15.

The xx % and yy % thresholds provide a criteria 106 that may be set according to any level of acceptable display appearance determined for the device 10. These thresholds may also be set differently depending on the type of image displayed. For example, in a multimedia application such as a picture viewer, the threshold percentages may be set lower to improve image quality.

Once the display 14 has been found to exceed the threshold boundaries, the display 14 may be subjected to a filtering process to reduce the visibility of burn-in. It should be noted in this regard that burn-in of a pixel cannot be reversed. As such, filtering, in this regard, means subjecting pixels that are adjacent burned-in pixels to additional activation during an idle period (e.g., when the device 10 is being charged). Burning-in adjacent pixels during idle periods also reduces the brightness of the adjacent pixels to reduce the visibility of any burned-in patterns on the display.

In order to understand how the digital filtering process operates to improve image quality on a burned-in display, it is helpful to understand why the human eye is so sensitive to burn-in. H. L. Snyder, "The Visual System: Capabilities and Limitations" in the book "Flat Panel Displays and CRTs" edited by L. E. Tannas Jr., Van Nostrand Reinhold Co., N.Y. (1985) has investigated this issue. The visibility of display uniformity (where burn-in is a type of non-uniformity) is determined by both the size of the modulation of display luminance and the spatial frequency of the modulation. For example, a 5% modulation may not be visible if it occurs over a large spatial area; however, a 0.5% modulation may be easily visible over a much smaller area.

In general, modulation of display luminance is defined as $$\text{Modulation} = \frac{L_{max} - L_{min}}{L_{max} + L_{min}},$$

Where $L_{max}$ is the maximum luminance over a given viewing area and $L_{min}$ is the minimum luminance over the viewing area.

Figure 2:
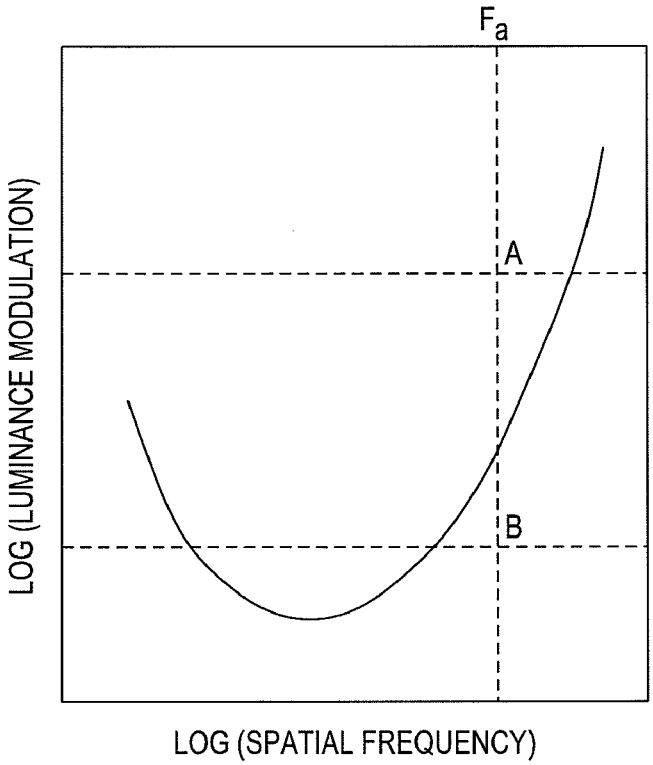
FIG. 2 depicts a graph that shows the limits of visible burn-in in terms of luminance versus spatial frequency that may be used by the system of FIG. 1.

FIG. 2 depicts threshold values of modulation visibility in terms of the log of luminance modulation versus the log of spatial frequency. The curve is related to the human eye's ability to resolve a modulation in display brightness. The human eye would see burn-in images with (luminance, spatial frequency) values above the curve (e.g., point A) whereas the human eye would not be sensitive to burned-in images with (luminance, spatial frequency) values below the curve (e.g., point B). Below the curve, the modulation is not visible to human eyes. Thus for a given spatial frequency $F_a$, modulation location A is visible while location B is not.

Figure 3:
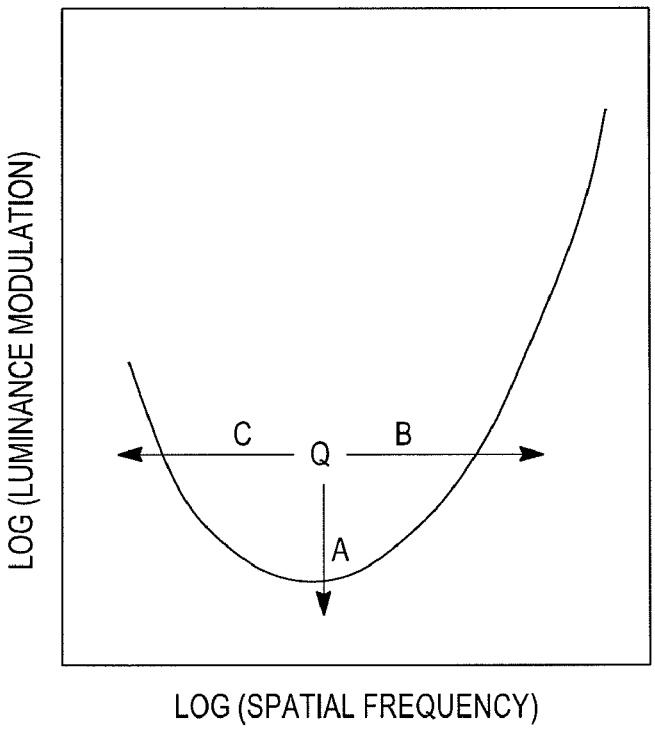

Using the human eye response curve shown in FIG. 2, the digital filter 42 functions to: 1) identify luminance modulations in an image that will be visible in a burned-in display (e.g., point Q in FIG. 3) and 2) alter the image so that the burn-in is made unrecognizable by lowering its modulation below the curve (path A of FIG. 3) or by changing the spatial frequency (paths B or C of FIG. 3). Path C is possible because the system 12 can smear out the burn-in over a lower frequency; however, it is difficult to go along path B because the display pixels have a finite size. For example, in the case of smearing out, a relatively narrow line burned across the display would have a relatively high spatial frequency. The spatial frequency may represent a rotation of only 180 degrees, but the rotation may still be of a relatively high spatial frequency. Intentionally burning-in the pixels 15 on both sides of the line to reduce the slope lowers the spatial frequency of the line.

Figure 4:
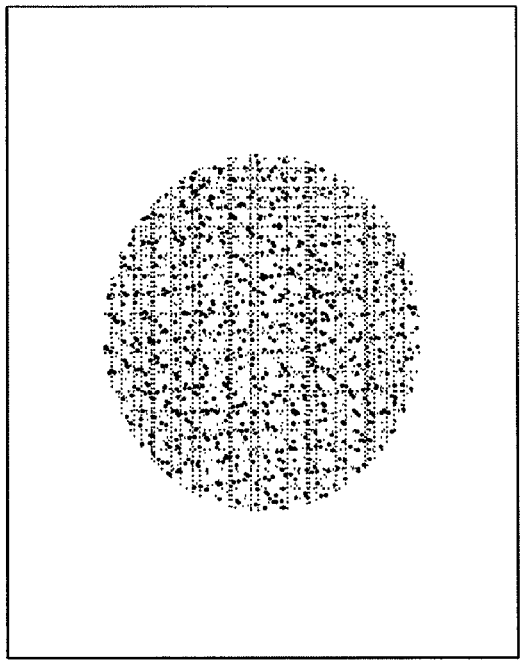
FIG. 4 depicts a modulation map that may be processed by the system of FIG. 1.

The digital filter 42 will be described next. As a first step in applying the digital filter 42 to correct the burn-in, a Fourier transform of the spatial frequency of the display is performed 104 by a Fourier transform processor 44. In this regard, FIG. 4 depicts an example of a modulation map 40 using the maximum brightness or maximum cumulative luminance of each pixel B(i, j). In the example of FIG. 4, the modulation map 40 has a circular burned-in area in the center of FIG. 4. The Fourier transform of the spatial modulation of FIG. 4 is saved in a Fourier transform file 46 and produces the map of Fourier components shown in FIG. 5. The Fourier transform uses the typical properties of the display 14 to reveal the size of the burn-in modulation as well as the spatial frequency. The properties needed would be pixel pitch (e.g., pixels per cm) and the distance of a user from the display as determined by the application (e.g., 20 cm for a mobile phone, 5 m for a television, etc.).

Figure 5:
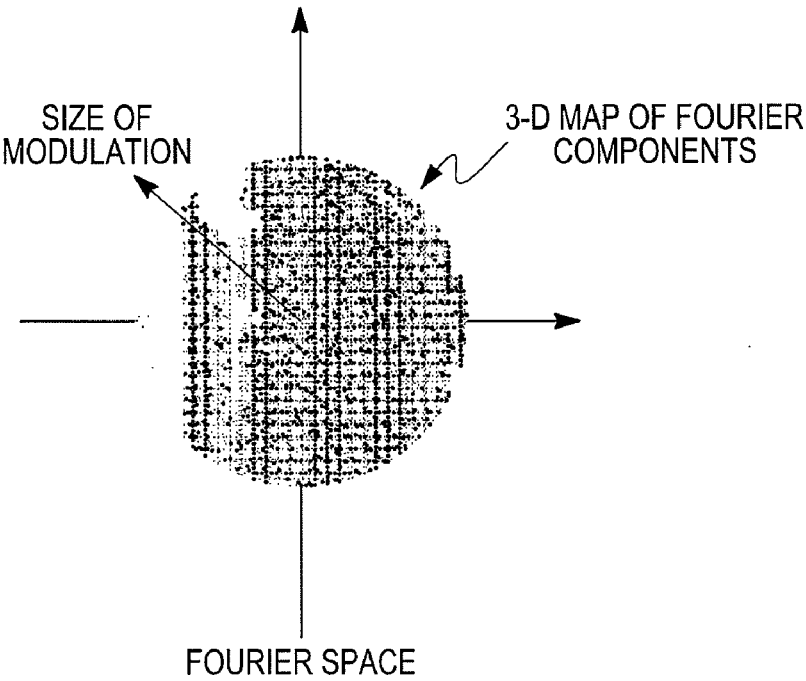
FIG. 5 depicts Fourier components of the modulation map of FIG. 4.
Figure 6:
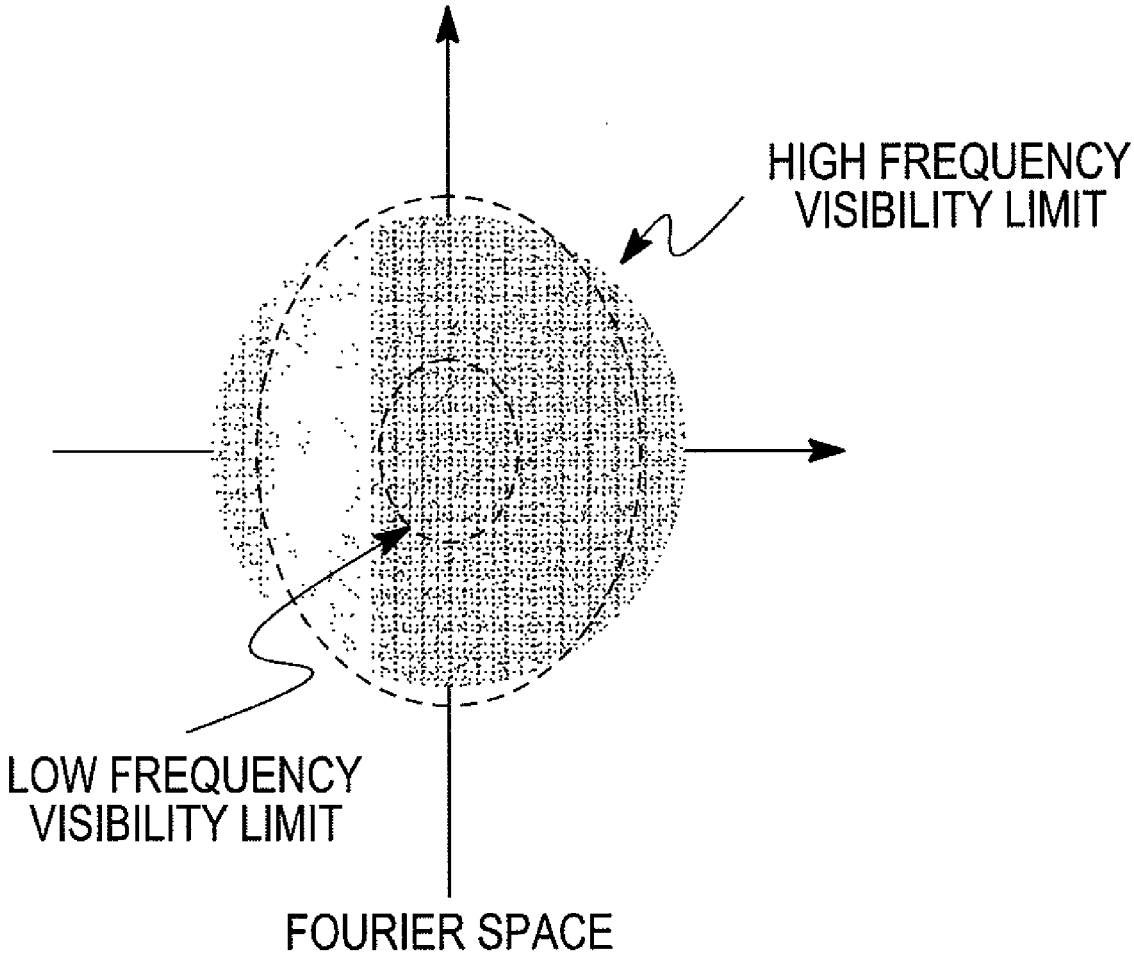
FIG. 6 depicts the graph of FIG. 5 superimposed with the limits the graph of FIG. 2.

Applying the visibility curve of FIG. 2 to the Fourier data of FIG. 5 produces the data shown in FIG. 6. In this case, the Fourier transform data provides the size of the modulation as well as the spatial frequency.

For any given amplitude, there is a k_max and a k_min in the Fourier data of FIG. 5 that corresponds to the curve of FIG. 2. By comparing the values of k_max and k_min of FIG. 5 with the data of FIG. 2, the curve of FIG. 2 can be mapped into the Fourier data of FIG. 5 resulting in the two dotted circles shown in FIG. 6 where the inner circle is the low frequency visibility limit and the outer circle is the high frequency visibility limit. For the given amplitude of FIG. 4, the Fourier components that are responsible for the burned-in image are those components between the two circles of FIG. 6. Since the two circles of FIG. 6 are mapped into the Fourier space, the area between the two circles of FIG. 6 identifies 110 the pixels responsible for the burned-in image.

Figure 7:
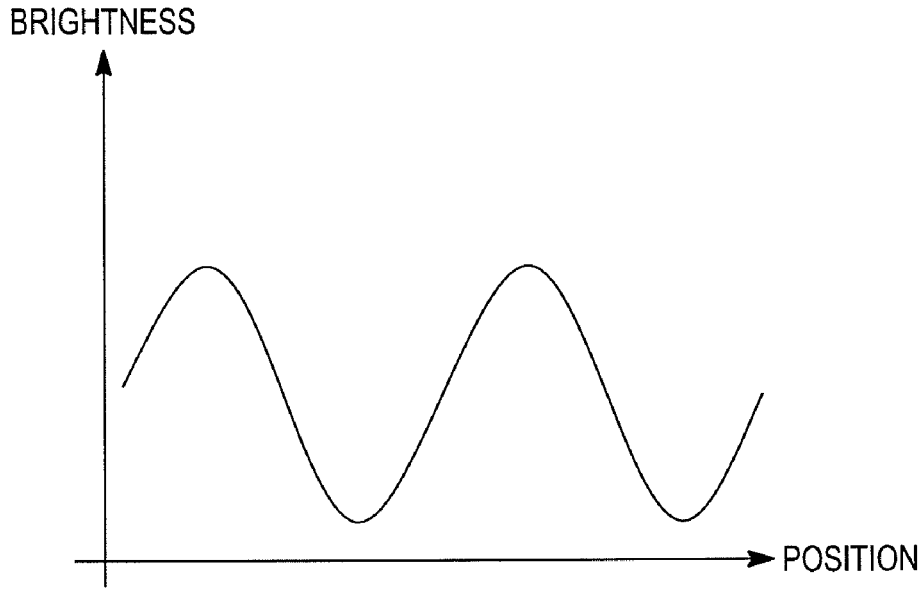
FIG. 7 depicts a graph of modulation components in terms of brightness versus position along one axis of a display that may be processed by the system of FIG. 1.

Thus, the first step of the filtering process is to identify the pixels that are responsible for the burned-in image. The second step is to determine how much the maximum cumulative luminance of adjacent pixels are to be adjusted to eliminate the burned-in image. Once the areas that cause the burn-in are identified, there are two ways to correct the burn-in as shown in FIG. 7.

The first method involves the use of an inverse Fourier transform processor 48 that takes the inverse Fourier transform 112 of the Fourier data within the modulation map 40, but phase shifts the location of the identified pixels by $\pi$. Phase shifting the location by $\pi$ produces the dotted line shown in FIG. 8. This corresponds to path A in FIG. 3 of lowering the modulation amplitude. This method is preferred if the burn-in image has a pseudo periodic modulation pattern over a large area of the display 14.

Figure 8:
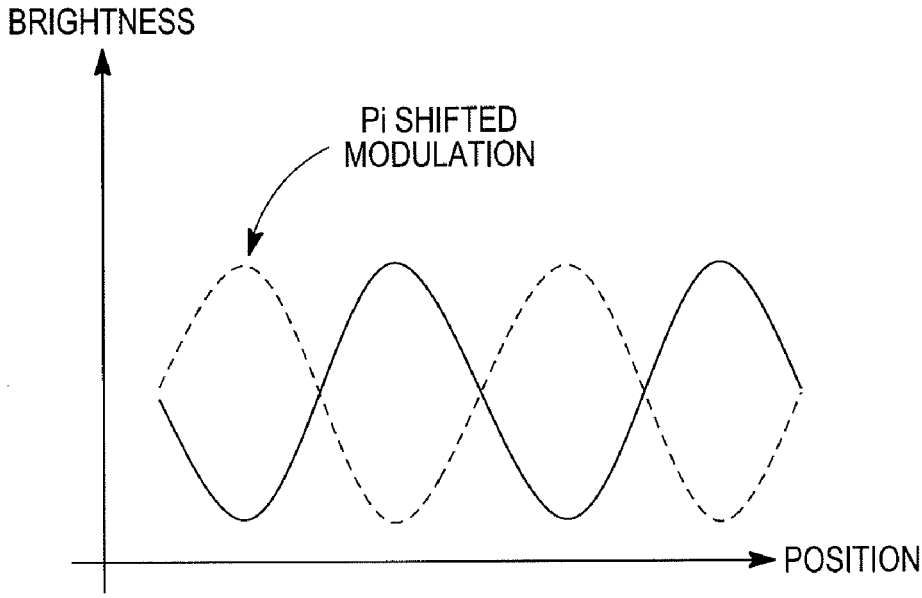
FIG. 8 shows the graph of FIG. 7 with the modulation components shifted by $\pi$.

In effect, the difference between the solid line and dotted lines along the brightness axis of FIG. 8 defines the change in maximum cumulative luminance of each corresponding pixel that is needed to correct the burn-in. The location along the position axis of FIG. 8 defines the location of the pixel that will be changed by the difference value.

The data of FIG. 8 may be transferred to a difference processor 50 where for each pixel 15, the brightness of the dotted line is subtracted from the solid line within a comparator 60 to determine a luminance correction to be applied to that pixel 15. The luminance correction value and a pixel identifier may be transferred to an adjustment processor 52 where the luminance correction value and pixel identifier may be saved in one or more adjustment maps 54.

In order to adjust the maximum cumulative luminance, the adjustment processor 52 may monitor a charging state 29 of the battery 28. When the adjustment processor 52 detects the charge state 29, the adjustment processor 52 may activate the driver 20 in accordance with the one or more adjustment maps 54. In this case, the activation of the driver 20 has the effect of further burning-in the identified pixels 15 by the luminance correction factor thereby reducing the maximum cumulative luminance for the identified pixels 15.

In another embodiment, burn-in may be corrected by smearing out 114 the area of the burn-in so that the burn-in area defines a lower spatial frequency and hence is no longer visible. This would be appropriate if the burn-in pattern is localized. This corresponds to path C of FIG. 3 by lengthening the scale (i.e., the wavelength) of the brightness change.

In this case, the process may proceed as above where modulation map 38 is Fourier transformed as above and compared with the data of FIG. 2 to detect the visible component in burn-in.

Figure 10:
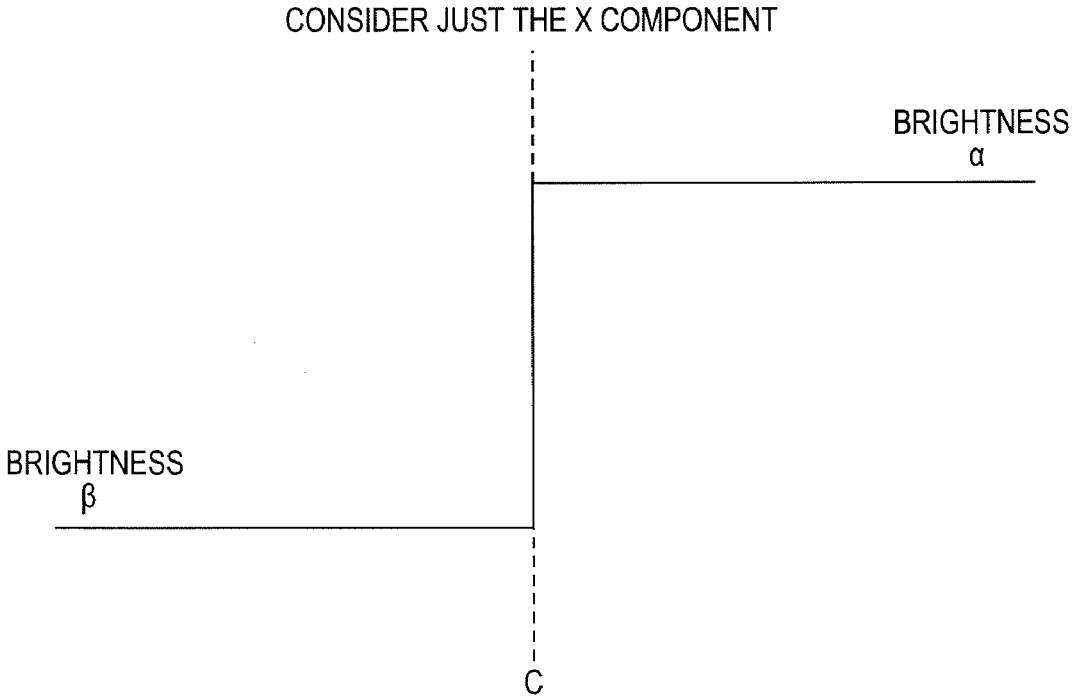
FIG. 10 shows a portion of the brightness map of FIG. 9.

As shown in FIG. 10, along the x-axis and at coordinate C, the brightness changes from a brightness of $\beta$ to a brightness of $\alpha$. The brightness of the display 14 may be spread out by a smearing processor 56 to create a longer spatial modulation in accordance with the spreading function equation as follows, $$f(x) = \frac{\alpha - \beta}{2}\mathrm{erf}\left[\frac{x - c}{\delta}\right] + \frac{\alpha + \beta}{2},$$

where $f(x)$ is the brightness as a function of x, "erf" is an error function and $\delta$ is a smearing factor. It should be noted here that $\alpha$ and $\beta$ are known from the inverse Fourier transform data or modulation map. The error function is a known mathematical function. The value $\delta$ can be determined from FIG. 2. The result of the application of the spreading function equation to FIG. 10 produces the data of FIG. 11.

It should be noted that while spreading may be performed with the error function, other possible ways of doing this are also available. For example, a Gaussian function could also be used to serve the same function.

Figure 11:
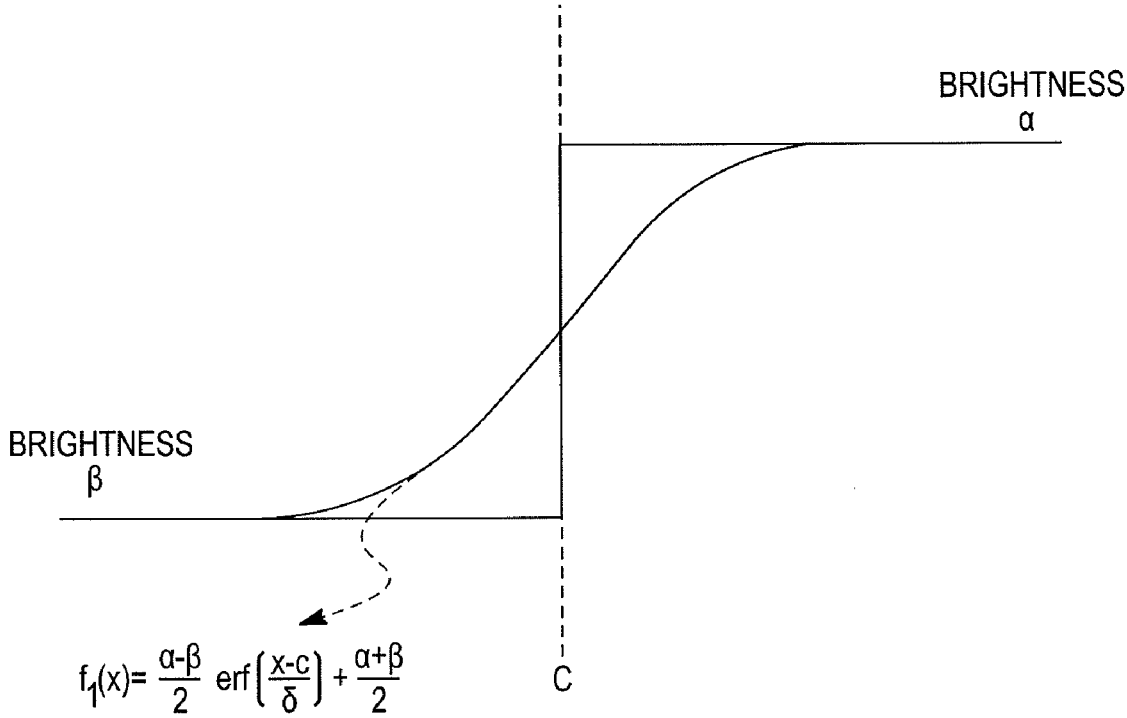
FIG. 11 shows a curve of adjustment factors that may be produced by the system of FIG. 1 from the map of FIG. 10.

It should be noted that while the curve of FIG. 11 would be effective, it is not realizable. It is not realizable because (as shown in FIG. 1) to the left of (x position) C, it is not possible to increase the maximum cumulative luminance of a pixel.

Figure 12:
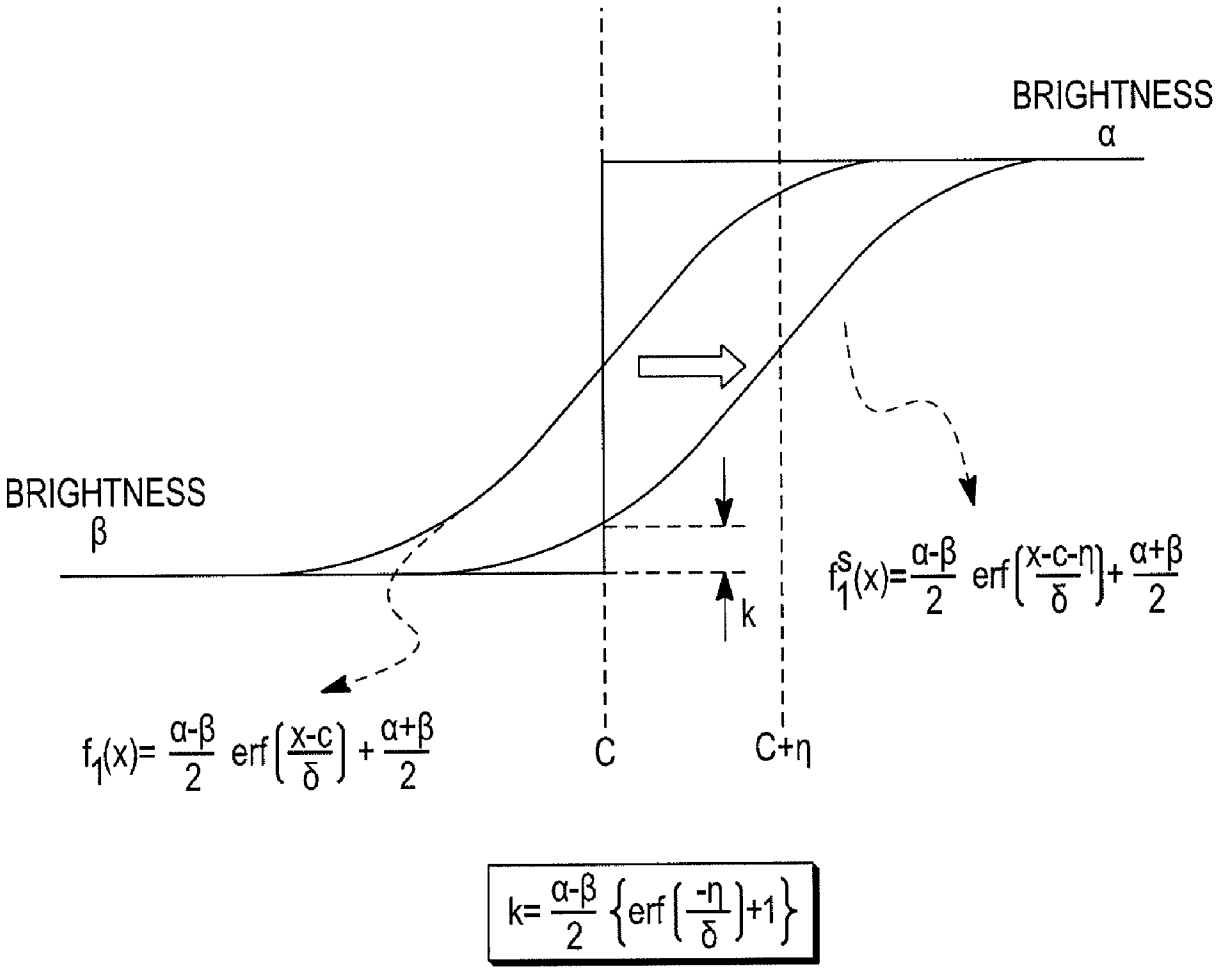
FIG. 12 shows the curve of FIG. 11 shifted to avoid a step function.

As such, it becomes necessary to shift the curve of FIG. 11 to the right. Shifting to the right is shown in FIG. 12 and can be accomplished in accordance with a shifting spreading function equation as follows, $$f^s(x) = \frac{\alpha - \beta}{2}\mathrm{erf}\left(\frac{x - c - \eta}{\delta}\right) + \frac{\alpha + \beta}{2},$$

where, as above, $f^s(x)$ is the shifted brightness as a function of x, "erf" is an error function, $\delta$ is a smearing factor and $\eta$ is the shifted distance along the x axis. It should be noted that a step in luminance κ may be allowed to minimize the extent of the shift along the axis. The value of κ may be determined from the equation, $$\kappa = \frac{\alpha - \beta}{2}\left[\mathrm{erf}\left(\frac{-\eta}{\delta}\right) + 1\right].$$

As above, the value of κ may be determined from FIG. 2 based upon the largest step function that would not be visible.

Figure 9:
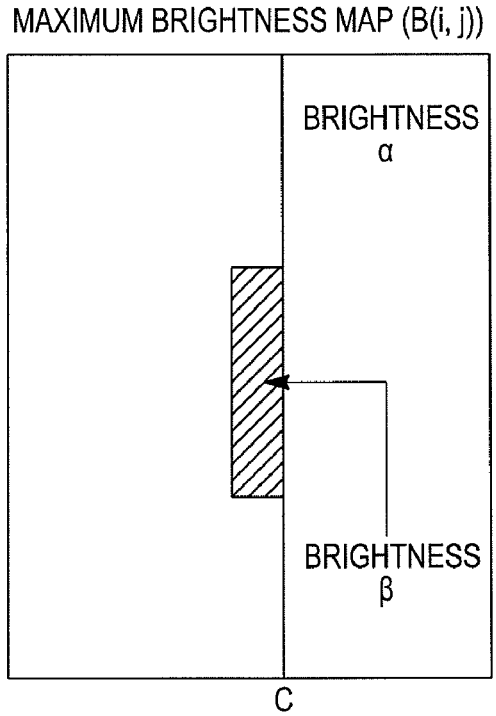
FIG. 9 shows a brightness map that may be processed by the system of FIG. 1.

Using the function $f^s(x)$, the smearing processor 56 may calculate a location and maximum cumulative luminance for each pixel 15. The smearing processor 56 may repeat the process of calculating the maximum cumulative luminance correction values using the function $f^s(x)$ for the right side of the discontinuity of FIG. 9. Similarly, the smearing processor 56 may perform the same steps along the y axis.

Once the process of calculating the maximum cumulative luminance is completed, the smearing processor 56 may save a luminance correction value and a pixel identifier in the one or more adjustment maps 54 as described above. The adjustment processor 52 may correct the maximum cumulative luminance as discussed above.

Figure 22:
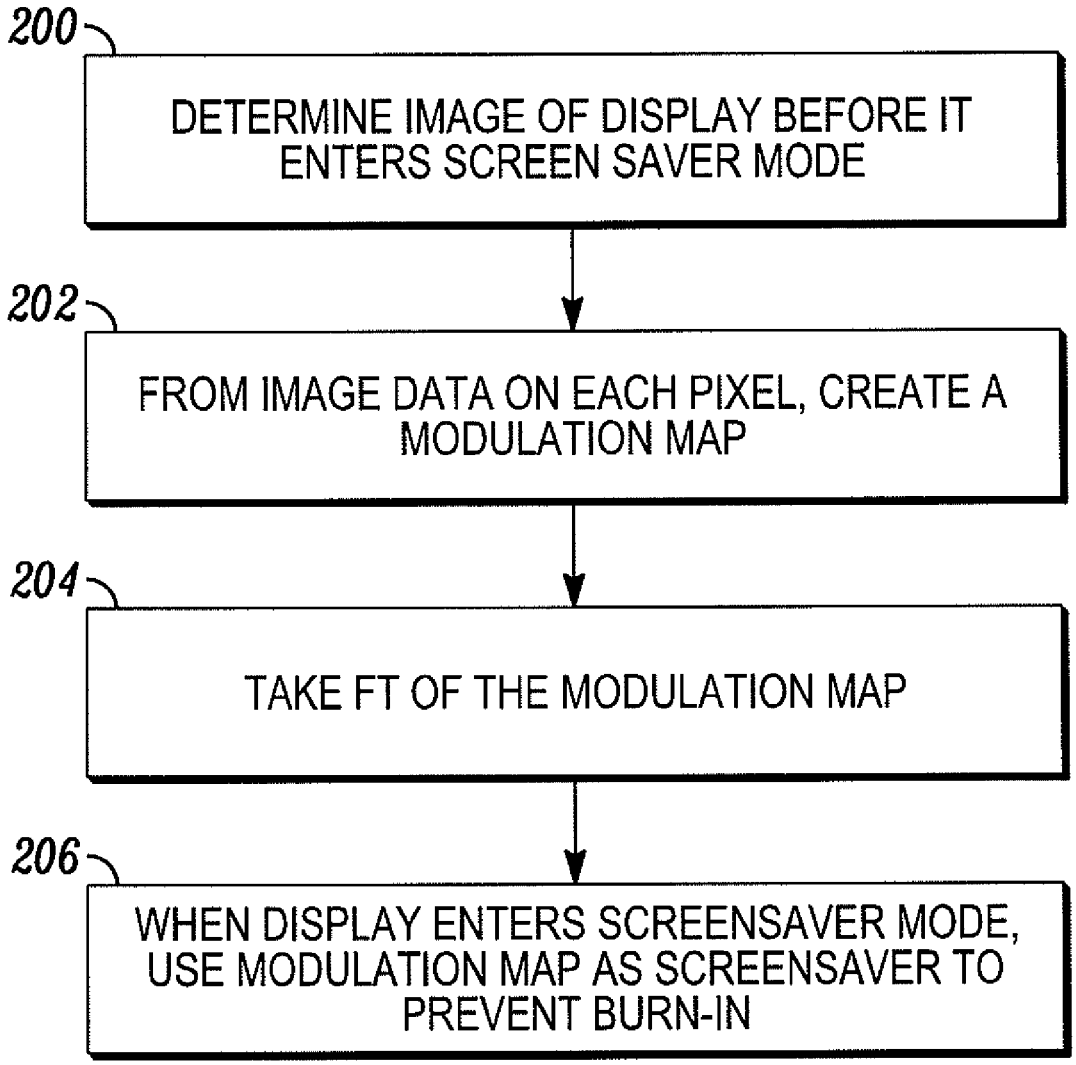
FIG. 22 depicts an alternate method of correcting burn-in that may be used by the system of FIG. 1.

In another embodiment shown in FIG. 22, the burn-in correction system 10 may correct burn-in through the use of predetermined adjustments maps 54 based upon commonly used user-interface screens and a predominant display image. In this case, a predominant image is an image that is displayed longer than other images and that causes faster aging of the pixels that define the image.

Figure 13:
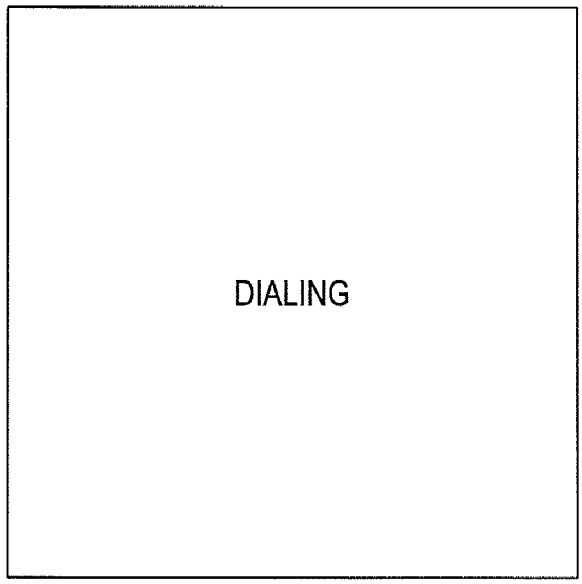
FIG. 13 shows a burned-in pattern that may be corrected by the system of FIG. 1.

In this case, a maximum cumulative luminance may be determined 200 for each pixel based upon how long each user interface screen is normally displayed. For example, the DIALING screen of FIG. 13 may be displayed for 15 seconds after a user of a cellphone enters a number and activates a SEND button. In this case, the usage processor 34 may simply count the number of calls made to determine a usage of each pixel 15.

As above, the usage of each pixel 15 for each interface screen may be converted 202 into a modulation map 40. Similarly, the modulation map may be transformed 204 into a modulation index for each pixel location in the map and when the modulation indexes exceed a set of threshold values, the luminosity of adjacent pixels may be adjusted 206 when the display enters a screen saver mode.

In another illustrated embodiment, FIGS. 14-19 shows a method of correcting burn-in from interface screens using a screen saver. In this case, the adjustment of maximum cumulative luminance is performed while the device is being actively used by a user.

Figure 14:
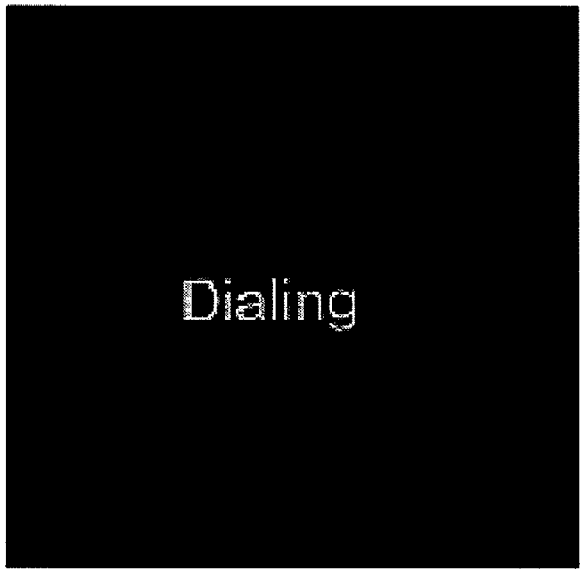
FIG. 14 shows a correction factor that may be used to correct the burned-in pattern of FIG. 13.
Figure 15:
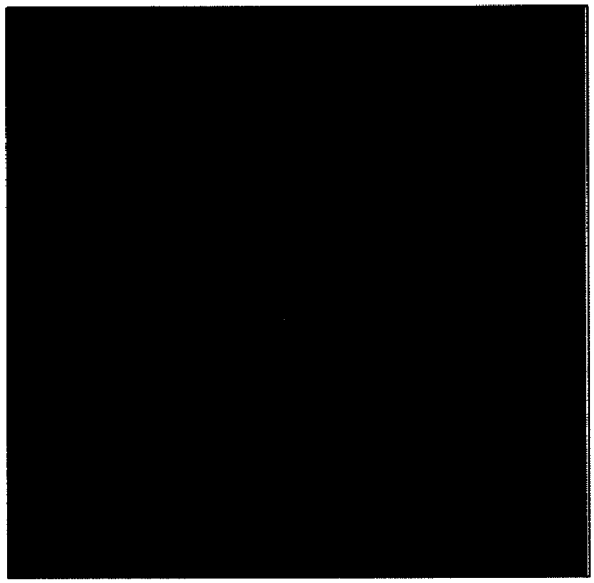
Figure 16:
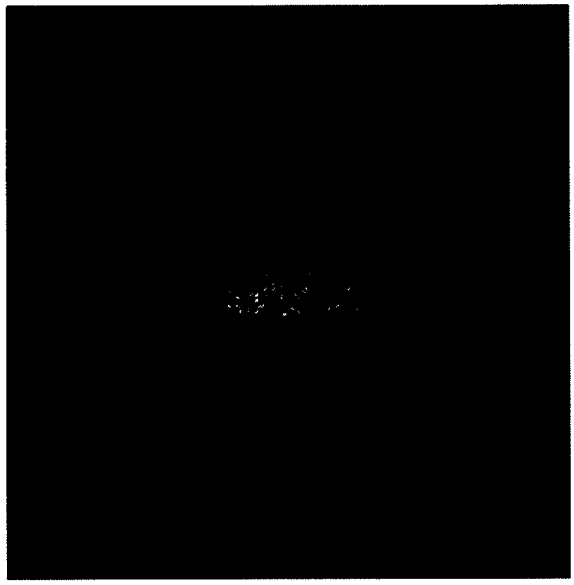
Figure 17:
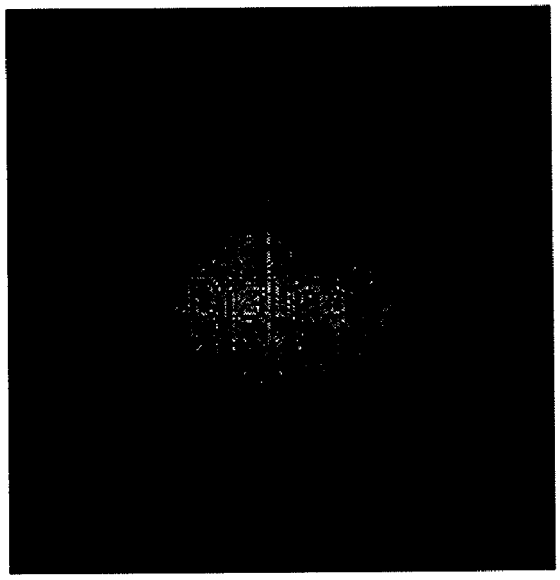
Figure 18:
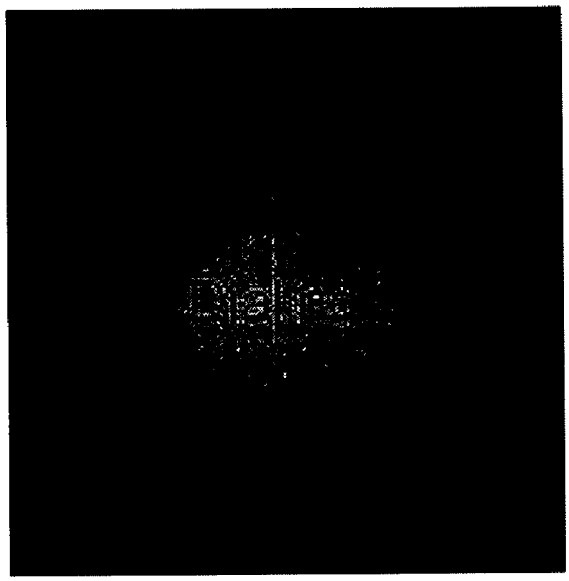
Figure 19:
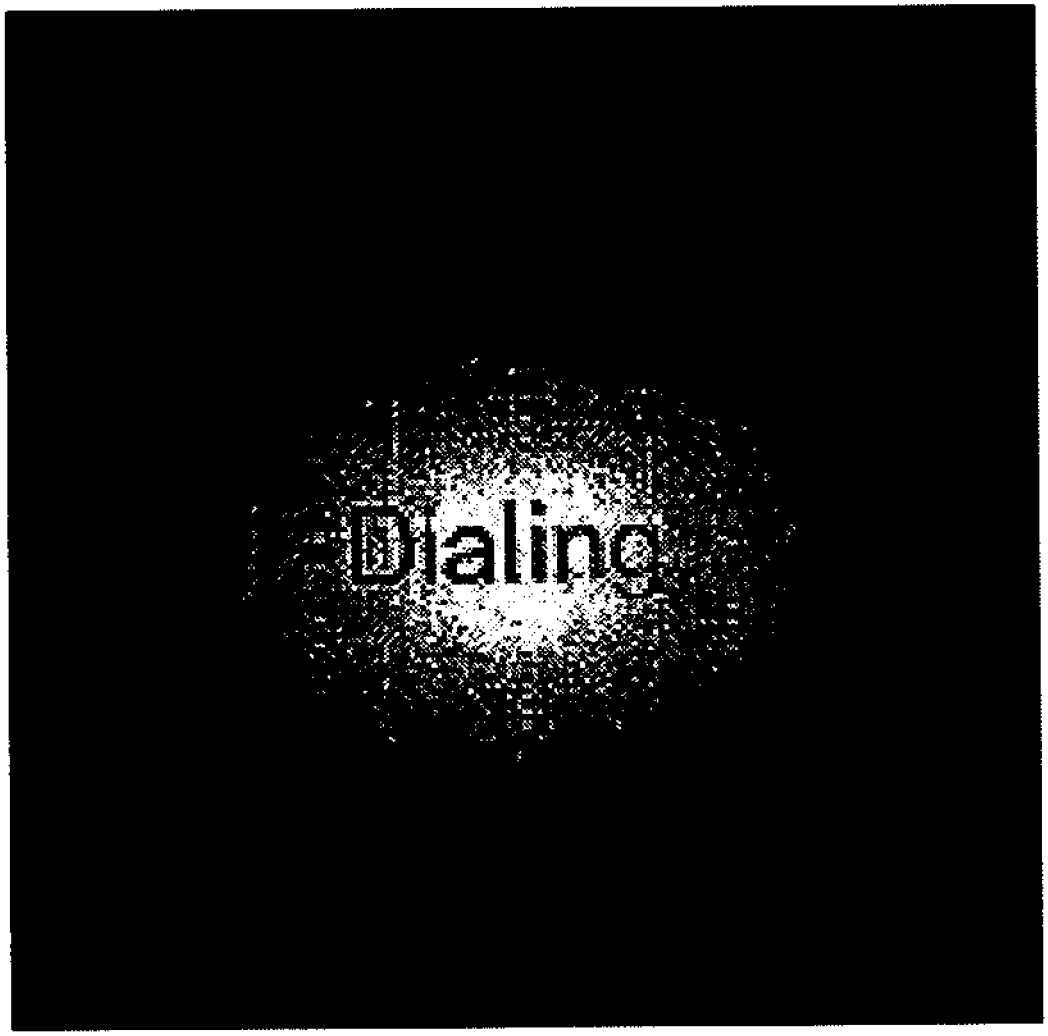

In order to correct burn-in under this embodiment, the processes described above may be used to create a series of adjustment maps 54 that are used under control of a screen saver time base to correct burn-in. For example, the word DIALING of FIG. 13 may be shown on the display 14 for 15 seconds after the user activates the SEND button. After 15 seconds, a screen saver processor 58 may retrieve a sequence of adjustment maps 54 to smear the burn-in that would otherwise be created by the display of the word DIALING. In this case, the smearing of the burn-in can be performed by first inverting the image (e.g., "on" pixels are deactivated and "off" pixels are activated) as shown in FIG. 14 and then fading away the display around the areas where burn-in may occur as shown in FIGS. 15-19. This has the added benefit of the information remaining displayed as the image fades out.

A significant advantage of this embodiment is that it does not require the direct tracking of the usage of each pixel. Rather, this embodiment prevents burn-in of the most frequently used images, such as the images displayed during any typical use of the device. The last image shown at the completion of any user-entered command (e.g., DIALING), often remains on the screen for many seconds. These images are the most likely to cause burn-in. This embodiment avoids the instances of such burn-in.

A specific embodiment of method and apparatus for correcting burn-in has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A method of correcting burn-in in a display comprising:

determining a maximum cumulative luminance of each pixel within the display based upon a usage of the pixel;

providing a modulation map of the display from the maximum cumulative luminance of each pixel within the display;

transforming the modulation map based upon the maximum cumulative luminance of groups of adjacent pixels to provide a modulation index for each pixel location of the map;

comparing the modulation indexes with a set of threshold values; and adjusting a luminosity of associated pixels of the display when the modulation index exceeds the threshold, wherein the step of transforming the map further comprises Fourier transforming the modulation map including phase shifting at least a portion of the transformed map exceeding the threshold by a value of π.

2. The method of correcting burn-in in the display of claim 1 wherein the step of determining the maximum cumulative luminance of each pixel further comprises measuring a time of activation of each pixel.

3. The method of correcting burn-in in the display of claim 1 wherein the step of determining the maximum luminance of each pixel further comprises measuring a time and current of activation of each pixel.

4. The method of correcting burn-in in the display of claim 1 further comprising inverse Fourier transforming the shifted map.

5. The method of correcting burn-in in the display of claim 4 further comprising adjusting a maximum cumulative luminance of at least some pixels of the modulation map based upon a difference in respective values between the modulation map and the shifted map.

6. The method of correcting burn-in in the display of claim 1 further comprising inverting a pixel activation pattern surrounding a predominant display image.

7. An apparatus for correcting burn-in in a display comprising:

means for determining a maximum cumulative luminance of each pixel within the display based upon a usage of the pixel;

means for providing a modulation map of the display from the maximum cumulative luminance of each pixel within the display;

means for transforming the modulation map based upon the maximum cumulative luminance of groups of adjacent pixels to provide a modulation index for each pixel location of the map;

means for comparing the modulation indexes with a set of threshold values; and means for adjusting a luminosity of associated pixels of the display when the modulation index exceeds the threshold, wherein the means for transforming the map includes means for Fourier transforming the modulation map, the means for Fourier transforming the map includes means for phase shifting at least a portion of the transformed map by a value of $\pi$.

8. The apparatus for correcting burn-in in the display of claim 7 wherein the means for determining the maximum cumulative luminance of each pixel further comprises means for measuring a time of activation of each pixel.

9. The apparatus for correcting burn-in in the display of claim 7 wherein the means for determining the maximum luminance of each pixel further comprises measuring a time and current of activation of each pixel.

10. The apparatus for correcting burn-in in the display of claim 7 further comprising means for inverse Fourier transforming the shifted map.

11. The apparatus for correcting burn-in in the display of claim 10 further comprising means for adjusting a maximum cumulative luminance of at least some pixels of the modulation map based upon a difference in respective values between the modulation map and the shifted map.

12. The method of correcting burn-in in the display of claim 7 wherein the means for adjusting further comprising means for inverting a pixel activation pattern surrounding a predominant display image.

* * * * *